US008613443B2

(12) United States Patent
Matsumoto

(10) Patent No.: US 8,613,443 B2
(45) Date of Patent: Dec. 24, 2013

(54) IMAGE FORMING APPARATUS

(75) Inventor: Keigo Matsumoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/409,430

(22) Filed: Mar. 1, 2012

(65) Prior Publication Data

US 2012/0223471 A1 Sep. 6, 2012

(30) Foreign Application Priority Data

Mar. 2, 2011 (JP) ..... 2010-044712

(51) Int. Cl.
*B65H 5/00* (2006.01)

(52) U.S. Cl.
USPC ..... 271/225; 271/902; 399/124; 399/401

(58) Field of Classification Search
USPC ..... 271/225, 186, 65, 902; 399/124, 401
See application file for complete search history.

(56) References Cited

U.S. PATENT DOCUMENTS 5,449,166 A * 9/1995 Lohmann et al. ..... 271/225
5,513,840 A * 5/1996 Fujita et al. ..... 271/301
5,953,575 A * 9/1999 Park et al. ..... 399/401
5,974,283 A * 10/1999 Cho ..... 399/75
6,032,949 A * 3/2000 Ando ..... 271/225
6,526,255 B2 * 2/2003 Itoh et al. ..... 399/401
7,641,191 B2 * 1/2010 Inui ..... 271/251
7,789,388 B2 * 9/2010 Matsubara et al. ..... 271/301
8,152,161 B2 * 4/2012 Samoto et al. ..... 271/186
8,240,655 B2 * 8/2012 Samoto et al. ..... 271/3.19
8,267,402 B2 * 9/2012 Saito ..... 271/301
8,447,223 B2 * 5/2013 Inui ..... 399/401
2010/0104301 A1 4/2010 Kato

FOREIGN PATENT DOCUMENTS

JP 2010-102173 A 5/2010

* cited by examiner

*Primary Examiner* — Jeremy R Severson
(74) *Attorney, Agent, or Firm* — Marvin A. Motsenbocker; Mots Law, PLLC

(57) ABSTRACT

An image forming apparatus includes a main body. The main body includes an image forming unit configured to form an image on a medium, and a media conveyance mechanism configured to convey the medium to the image forming unit. A media conveyance unit is attached to the main body and is configured to convey the medium to the media conveyance mechanism. A media retreat path is defined by opposed surfaces of the media conveyance unit and the main body which are opposed to each other. The media retreat path is configured to receive at least a part of the medium being retreated. The media retreat path inclines in a way that a height level of the media retreat path gradually becomes lower from its entrance side to its back-end side.

24 Claims, 10 Drawing Sheets

IMAGE FORMING APPARATUS

CROSS REFERENCE TO RELATED APPLICATIONS

This application claims priority based on 35 USC 119 from prior Japanese Patent Application No. 2011-044712 filed on Mar. 2, 2011, entitled "IMAGE FORMING APPARATUS", the entire contents of which are incorporated herein by reference.

BACKGROUND OF THE INVENTION

1. Field of the Invention

The present disclosure relates to an image forming apparatus which includes a main body and a media conveyance unit attached to the main body.

2. Description of Related Art

In an image forming apparatus capable of duplex printing, the image forming unit performs printing on a first side of a medium (a sheet of paper); thereafter, the media conveyance unit for duplex printing (the media conveyance unit) reverses the medium and conveys it to the image forming unit again; and the image forming unit performs printing on a second side of the medium.

The media conveyance unit for duplex printing reverses the medium by a "switchback operation" in which the medium having printing performed on one side is temporarily retreated into a retreat path by rotating the conveyance rollers, and thereafter is ejected from the retreat path by reversely rotating the conveyance rollers (see Japanese Patent Application Publication No. 2010-102173, FIG. 6, for example).

Nevertheless, conventional image forming apparatuses tend to become bulky because of their retreat paths.

An object of an embodiment of the invention is to make an image forming apparatus smaller in size.

SUMMARY OF THE INVENTION

An aspect of the invention is an image forming apparatus including: a main body including an image forming unit configured to form an image on a medium, and a media conveyance mechanism configured to convey the medium to the image forming unit; a media conveyance unit attached to the main body and configured to convey the medium to the media conveyance mechanism; and a media retreat path defined by paired opposed surfaces of the media conveyance unit and the main body and configured to receive at least a part of the medium when being retreated. The media retreat path inclines in a way that a height level of the media retreat path gradually becomes lower from its entrance side to its back-end side.

Another aspect of the invention is an image forming apparatus including: a main body including an image forming unit configured to form an image on a medium, and a media conveyance mechanism configured to convey the medium to the image forming unit; a media conveyance unit attached to the main body and configured to convey the medium to the media conveyance mechanism; and a media retreat path defined by paired opposed surfaces of the media conveyance unit and the main body, and configured to receive at least a part of the medium being retreated.

The aspects make it possible to make the media conveyance unit smaller in size, because the space between the media conveyance unit and the main body of the image forming apparatus is defined as the media retreat path.

In addition, one of the aspects makes it possible to reduce the horizontal dimension of the image forming apparatus, including the media conveyance unit for duplex printing, because the media retreat path inclines to the horizontal plane.

DETAILED DESCRIPTION OF EMBODIMENTS

Figure 1:
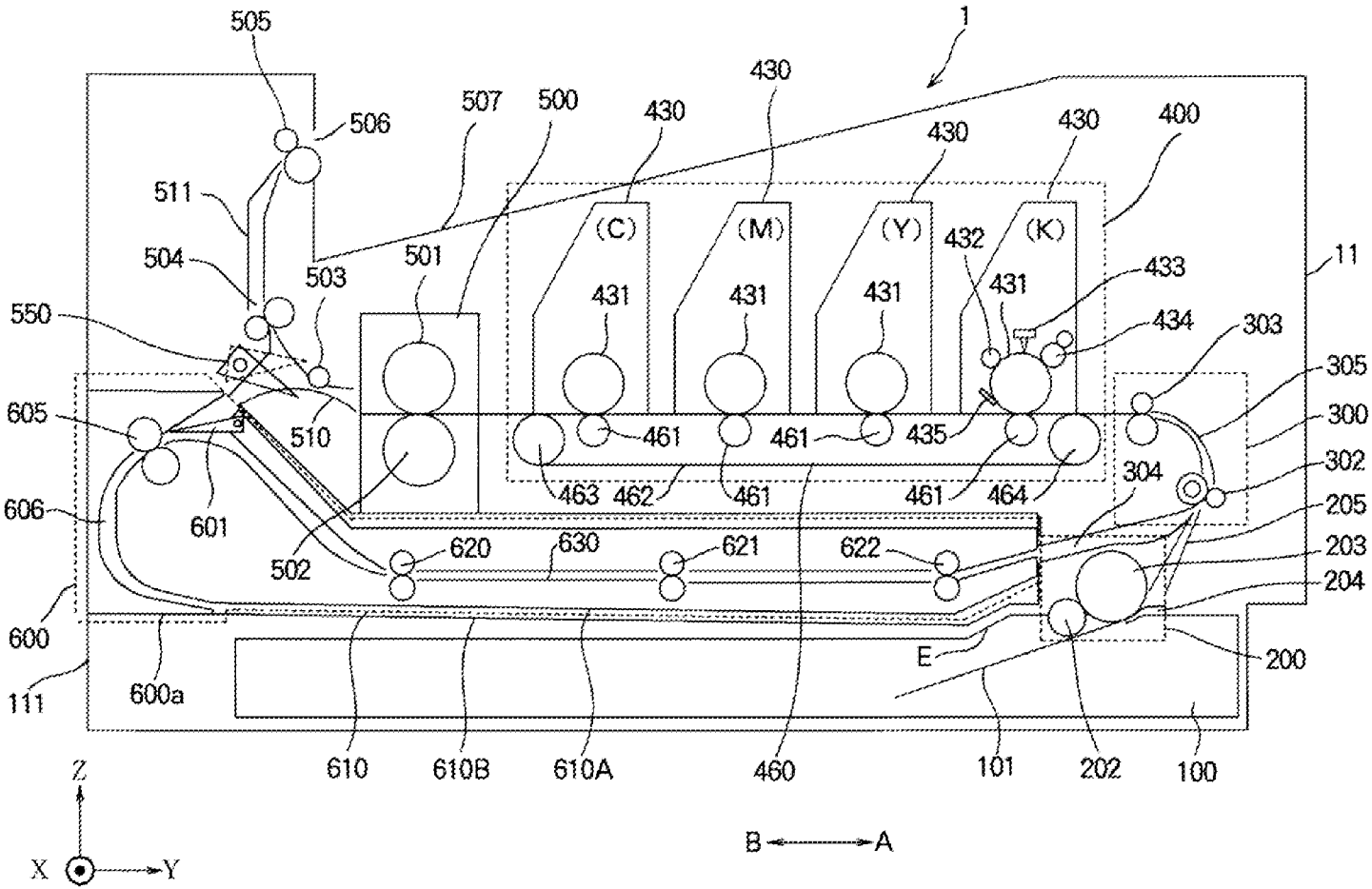
FIG. 1 is a diagram showing an image forming apparatus including a media conveyance unit for duplex printing in a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

FIG. 1 is a diagram showing an image forming apparatus including a media conveyance unit for duplex printing of a first embodiment of the invention. Image forming apparatus 1 includes, in its lower portion, media tray 100 configured to store media 101 (for example, sheets of paper) while stacking media 101. Media tray 100 has a swingable placement plate, although not illustrated. Media tray 100 is designed to push up media 101 which are placed on the placement plate.

Media feed mechanism 200 configured to feed media 101 from media tray 100 on a one-by-one basis is provided in the feeding side of media tray 100 (on the right side of medium tray 100 in FIG. 1). Media feed mechanism 200 includes:

pickup roller 202 configured to come into pressure contact with media 101 which are raised to a predetermined height by the placement plate; and feed roller 203 and separation piece 204 configured to separate media 101, which are fed by pickup roller 202, one after another, and to send each medium 101 to conveyance path 205.

Media conveyance mechanism 300 is configured to convey medium 101, which is sent by media feed mechanism 200 to conveyance path 205, to image forming unit 400 along conveyance path 305. Media conveyance mechanism 300 is placed above the media feed mechanism 200. Media conveyance mechanism 300 includes two conveyance roller pairs 302, 303 which are arranged along conveyance path 305.

Image forming apparatus 1 further includes image forming unit 400 configured to form an image on medium 101 which is conveyed by media conveyance mechanism 300. Image forming unit 400 includes: four toner image forming sections (developer image forming sections) 430 arranged in a row; transfer section 460 configured to transfer toner images, which are formed respectively by toner image forming sections 430, to the upper surface of medium 101 by use of the Coulomb force. Four toner image forming sections 430 are those configured to form, for example, black (K), yellow (Y), magenta (M) and cyan (C) toner images by use of black (K), yellow (Y), magenta (M) and cyan (C) toners (developers), respectively, in that order from the upstream in the media conveyance direction (from the right in FIG. 1).

Each toner image forming section 430 includes photosensitive drum 431 (image carrier) configured to rotate in one direction (in this case, in a clockwise direction). Arranged around each photosensitive drum 431 in the rotational direction of photosensitive drum 431 are: charging roller 432 (charging device) configured to charge the surface of photosensitive drum 431 evenly, exposure device 433 configured to form an electrostatic latent image by exposing the evenly-charged surface of photosensitive drum 431 to light, development roller 434 (developer carrier) configure to develop the electrostatic latent image, which is formed on the surface of photosensitive drum 431, with a corresponding toner, and cleaning member 435 configured to clean part of the toner, which remains on the surface of photosensitive drum 431 after the transfer, off the surface of photosensitive drum 431.

It should be noted that FIG. 1 only shows the inner components of toner image forming section 430 in the rightmost end (the black (K) toner image forming section) alone, because the components are common among the other toner image forming sections 430 ((C), (M) and (Y)), except for toner (developer) types.

In this respect, let us assume that toner image forming sections 430 are horizontally arranged in a row. The direction in which toner image forming section 430 are arranged is defined as the Y direction. In addition, the direction in which the rotary shaft of each photosensitive drum 431 extends is defined as the X direction. The XY plane is a horizontal plane. The direction vertical to this XY plane is defined as the Z direction (the vertical direction).

Transfer section 460 includes: four transfer rollers 461 (transfer members) arranged opposed to photosensitive drums 431 of toner image forming sections 430, respectively; transfer belt 462 provided, passing between photosensitive drum 431 and transfer rollers 461; drive roller 463 and driven roller 464 around which transfer belt 462 is stretched. Transfer belt 462 makes medium 101 adhere to its surface with an electrostatic force, and conveys medium 101 by rotations of drive roller 463 along four toner image forming sections 430 in the left direction (direction B) in FIG. 1.

Fixation unit 500 configured to fix the toner images to medium 101 is placed downstream of image forming unit 400 and transfer section 460 in the media conveyance direction (in the left portion in FIG. 1). Fixation unit 500 includes heater roller 501 and pressure roller 502, respectively, configured to apply heat and pressure to the toner images which are transferred to medium 101.

Conveyance path 510 and guidance roller 503 configured to convey medium 101, to which the toner images are fixed by fixation unit 500, in the left direction in FIG. 1 are provided downstream of fixation unit 500 in the media conveyance direction (in the left portion in FIG. 1). In addition, conveyance path 510 is provided with selector (switching section) 550 configured to switch the conveyance direction of medium 101.

Selector 550 is configured to be swingable between a first position (indicated with a continuous line) and a second position (indicated with a dashed line). In the first position, selector 550 guides the travelling direction of medium 101, which is conveyed from fixation unit 500 along conveyance path 510, toward discharge roller pair 504, which is described later. In the second position, selector 550 guides the travelling direction of medium 101 toward media conveyance unit 600 for duplex printing, which is described later. Selector 550 is swung between the first and second positions by a motor (not illustrated) which is provided within the main body of image forming apparatus 1.

Discharge roller pair 504 configured to convey medium 101 toward discharge port 506, which is provided in an upper portion of image forming apparatus 1, along conveyance path 511 is provided above selector 550. In addition, discharge port 506 is provided with discharge roller pair 505. A top cover of image forming apparatus 1 is provided with load section 507 in which medium 101 discharged from discharge port 506 is loaded.

Image forming apparatus 1 thus configured, except for detachable components (for example, media conveyance unit 600 for duplex printing, and the like to be described later), are referred to as main body 11. In addition, a portion of main body 11 of image forming apparatus 1, to which media tray 100 above described is attached, is defined as main body lower portion 111.

Figure 2:
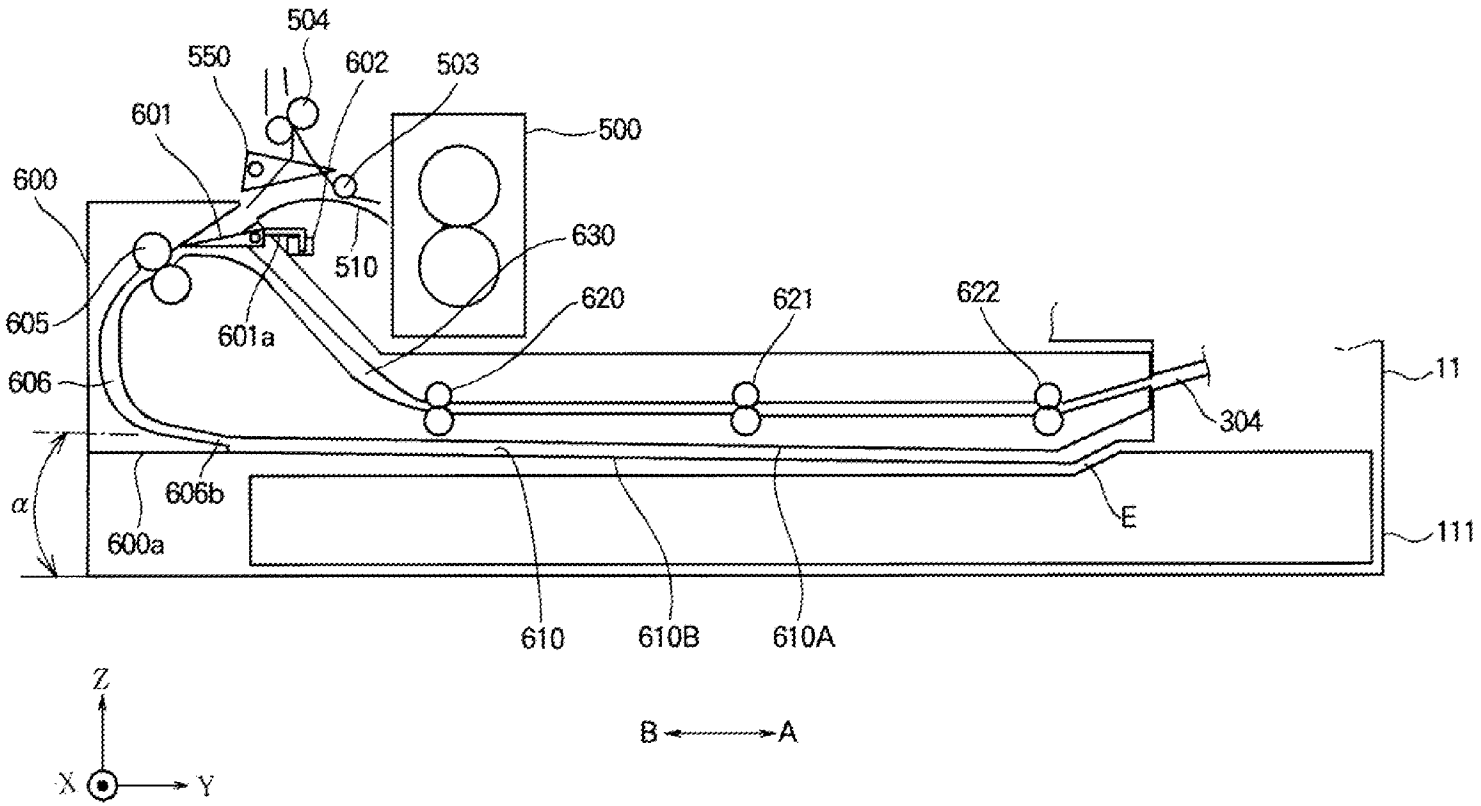
FIG. 2 is a diagram showing the media conveyance unit for duplex printing in the first embodiment of the invention.
Figure 3B:
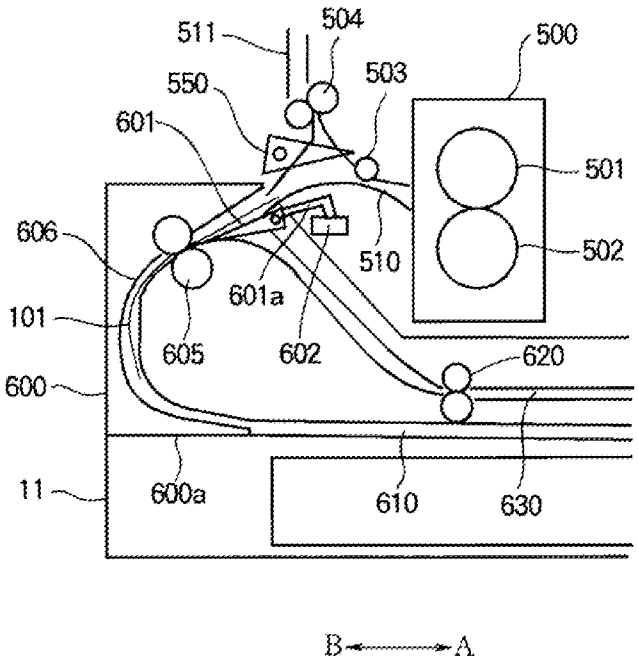
FIGS. 3A and 3B are diagrams for explaining how a media guide of the media conveyance unit for duplex printing operates in the first embodiment of the invention.
Figure 3A:
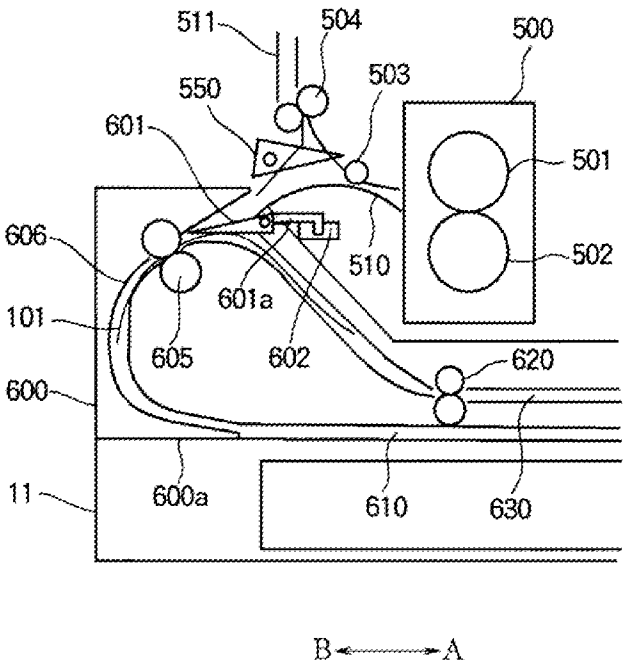

Next, descriptions are provided for media conveyance unit 600 for duplex printing of image forming apparatus 1. FIG. 2 is a diagram showing media conveyance unit 600 for duplex printing in a magnifying manner. FIGS. 3A and 3B are diagrams for explaining how media guide 601 operates in media conveyance unit 600 for duplex printing. Media conveyance unit 600 for duplex printing includes swingable media guide 601 which is adjacent to selector 550 described above. Media guide 601 is supported swingably upward and downward at a predetermined angle. Media guide 601 swings between a first position, to which media guide 601 swings upward as shown in FIG. 3A, and a second position to which media guide 601 swings downward as shown in FIG. 3B. The second position shown in FIG. 3B is a position where medium 101, conveyed from fixation unit 500 and then passed through selector 550, is guided to media retreat path 610, which is described later. Furthermore, the first position shown in FIG. 3A is a position where medium 101, ejected from media retreat path 610, is guided to return conveyance path 630, which is described later.

Media guide 601 is biased toward the first position (see FIG. 3A) by a spring, which is not illustrated. Media guide 601 swings downward and reaches the second position (see FIG. 3B), once medium 101, which is caused by selector 550 to enter media conveyance unit 600 for duplex printing from conveyance path 510, comes into contact with media guide 601. Thereby, medium 101 is guided to intermediate conveyance path 606. On the other hand, media guide 601 swings upward and returns to the first position (see FIG. 3A) due to the operation of the above-mentioned spring, while no medium 101 enters media conveyance unit 600 for duplex printing from selector 550 or is in contact with media guide 601.

Sensor 602 configured to detect the position of media guide 601 is provided in the vicinity of media guide 601. While media guide 601 is at the first position, light screen 601*a* attached to media guide 601 blocks the optical path of sensor 602. While media guide 601 is at the second position, light screen 601*a* is out of the optical path of sensor 602.

As shown in FIG. 2, in media conveyance unit 600 for duplex printing, conveyance roller pair 605 is configured to convey medium 101 to media retreat path 610 via intermediate conveyance path 606 and is placed in a position corresponding to the entrance of intermediate conveyance path 606. Conveyance roller pair 605 is connected to a motor (not illustrated) which is provided inside media conveyance unit 600 for duplex printing, and rotates by receiving the transmission of a rotary drive force from the motor.

In addition, media retreat path 610 is formed continuous to exit 606*b* (the lower end) of intermediate conveyance path 606. Media retreat path 610 is defined by media travel surfaces 610A, 610B which are vertically in parallel with, and opposed to, each other. Media retreat path 610 has an inclination $\alpha$ whose angle is in a range of 5 degrees to 20 degrees with respect to the horizontal plane (the XY plane) in a way that the height level of media retreat path 610 becomes gradually lower in a retreat direction of medium 101 (in the right direction in FIG. 2). Incidentally, the inclination $\alpha$ is set at 12 degrees in the embodiment.

Media travel surface 610A is formed on the undersurface of media conveyance unit 600 for duplex printing. To put it more specifically, media travel surface 610A is formed on the undersurface of media conveyance unit 600 for duplex printing, except for the vicinity of an end portion which is in contact with main body 11 of image forming apparatus 1 (which is indicated with reference sign 600*a* in FIG. 2).

On the other hand, media travel surface 610B is formed on main body 11 of image forming apparatus 1 in such a way as to be opposed to media travel surface 610A described above. To put it more specifically, media travel surface 610B is formed on the upper surface of main body lower portion 111, to which media tray 100 is attached, in main body 11 of image forming apparatus 1.

Incidentally, in FIG. 2, the right end portion of media retreat path 610 is provided with a portion (indicated with reference sign E in FIG. 2) which has an inclination where the height of media retreat path 610 becomes gradually higher toward pickup roller 202. However, this portion is not always necessary. Like the rest of media retreat path 610, this portion may have the inclination ($\alpha$).

Return conveyance path (referred to as "circulation path" as well) 630 is a conveyance path configured to covey medium 101 from media conveyance unit 600 for duplex printing to media conveyance mechanism 300. While in a duplex printing mode, for the purpose of reversing the front and back of medium 101, medium 101 is temporarily retreated into media retreat path 610 by conveyance roller pair 605, and thereafter is ejected from media retreat path 610 by reversely rotating conveyance roller pair 605, as well as is guided to return conveyance path 630.

Three conveyance roller pairs 620, 621, 622 are placed along return conveyance path 630. Conveyance roller pairs 620, 621, 622 rotate by receiving the transmission of a rotary drive force from the motor (not illustrated) which is provided inside the media conveyance unit 600 for duplex printing, and thereby convey medium 101 to media conveyance mechanism 300 along return conveyance path 630.

Next, referring to FIG. 1, descriptions are provided for how image forming apparatus 1 of the embodiment carries out duplex printing operation. First of all, image forming apparatus 1 forms an image on a first surface (front surface) of medium 101. In other words, pickup roller 202, feed roller 203 and separation piece 204 of media feed mechanism 200 feed media 101 from media tray 100 to conveyance path 205 on a one-by-one basis. Thereafter, conveyance roller pairs 302, 303 of media conveyance mechanism 300 convey each medium 101 to image forming unit 400 along conveyance path 305.

In image forming unit 400, transfer belt 462 of transfer section 460 receives and conveys medium 101 with an electrostatic force, and thereby makes medium 101 pass through four toner image forming sections 430 in succession. In each toner image forming section 430, an electrostatic latent image, which is formed on the surface of photosensitive drum 431 by exposure device 433, turns into a toner image as a result of being developed by development roller 434. The toner image is transferred by transfer roller 461 from photosensitive drum 431 to medium 101.

Medium 101, to which all the color toner images are transferred, is conveyed to fixation unit 500. In fixation unit 500, heater roller 501 and pressure roller 502 fix the toner images to medium 101 with their heat and pressure, and thereafter send medium 101 to conveyance path 510.

At this time, as shown by the dashed line of selector 550 in FIG. 1, selector 550 is at a position where selector 550 guides medium 101 from conveyance path 510 to media conveyance unit 600 for duplex printing. Medium 101 sent from fixation unit 500 is conveyed to media conveyance unit 600 for duplex printing along selector 550. Once entering media conveyance unit 600 for duplex printing, medium 101 presses down media guide 601 from the first position (see FIG. 3A) to the second position (see FIG. 3B), and further enters intermediate conveyance path 606. At this time, light screen 601*a* of media guide 601 goes out of the optical path of sensor 602, and the output from sensor 602 accordingly changes (from OFF to ON, for example).

Medium 101, which enters intermediate conveyance path 606, is conveyed by conveyance roller pair 605 along intermediate conveyance path 606, and reaches media retreat path 610. In other words, medium 101 retreats into media retreat path 610. The retreat of medium 101 into media retreat path 610 continues until the tail end of medium 101 finishes passing through media guide 610. For this reason, as the length of medium 101 becomes longer, medium 101 is conveyed to a deeper place in media retreat path 610. In a case where medium 101 with a largest length expected in the embodiment is used, the front end of medium 101 reaches a place immediately short of a part indicated with reference sign E in FIG. 1.

It should be noted that no conveyance roller pair has to be provided in media retreat path 610 because medium 101 is conveyed in media retreat path 610 while conveyance roller pair 605 is in pressure contact with medium 101.

Once the tail end of medium 101 passes through media guide 601, there is no longer anything configured to bias media guide 601 from above. For this reason, media guide 601 returns to the first position (see FIG. 3A) due to the biasing force of the spring. At this time, light screen 601*a* of media guide 601 enters the optical path of sensor 602, and the output from sensor 602 accordingly changes (from ON to OFF, for example). Once sensor 602 detects the passage of the tail end of medium 101, the rotational direction of conveyance roller pair 605 is reversed, and medium 101 starts to be ejected from media retreat path 610.

The reverse rotation of conveyance roller pair 605 draws medium 101 from media retreat path 610 via intermediate conveyance path 606. As shown in FIG. 3A, medium 101 comes into contact with media guide 601, and thereafter enters return conveyance path 630. In return conveyance path 630, conveyance roller pairs 620, 621, 622 are rotated by the motor which is not illustrated. Conveyance roller pairs 620, 621, 622 convey medium 101 to media conveyance mechanism 300.

Medium 101 conveyed to the terminal end of return conveyance path 630 reaches media conveyance mechanism 300 via conveyance path 304 which is formed inside main body 11 of image forming apparatus 1. In media conveyance mechanism 300, medium 101 is conveyed by conveyance roller pairs 302, 303, and reaches image forming unit 400 with the surface (second surface), on which no toner images are formed yet, laid face up. In image forming unit 400, transfer belt 462 of transfer section 460 receives and conveys medium 101 with an electrostatic force, and makes medium 101 pass through four toner image forming sections 430 in succession. The toner image formed by each toner image forming section 430 is transferred to the second surface of medium 101 by transfer roller 461.

Medium 101, to which all the color toner images are transferred, is conveyed to fixation unit 500. In fixation unit 500, heater roller 501 and pressure roller 502 fix the toner images to medium 101 with their heat and pressure, and send medium 101 to conveyance path 510.

At this time, as shown by the continuous line of selector 550 in FIG. 1, selector 550 is switched to the position where selector 550 guides medium 101 from conveyance path 510 to discharge roller pair 504. Medium 101, whose toner images have finished being fixed, is conveyed by discharge roller pair 504 toward discharge port 506 via conveyance path 511. Thereafter, medium 101 is discharged by discharge roller pair 505 through discharge port 506, and is loaded in load section 507. Thus, duplex printing on medium 101 is completed.

Next, descriptions are provided for what effects the embodiment brings about. In the embodiment, media retreat path 610 is formed between media conveyance unit 600 for duplex printing and main body 11 of image forming apparatus 1. Because of this configuration, the embodiment can make media conveyance unit 600 for duplex printing small, compared with a configuration in which media retreat path 610 is formed inside media conveyance unit 600 for duplex printing. As a result, the embodiment can make image forming apparatus 1 (including media conveyance unit 600 for duplex printing) small.

Because media retreat path 610 is inclined to the horizontal plane, the embodiment can make a length of media retreat path 610 long enough to retreat medium 101, and can make the horizontal dimension of media conveyance unit 600 for duplex printing small.

In addition, as described above, media retreat path 610 is provided with no conveyance rollers or the like. For this reason, if medium 101 would be conveyed in parallel with the horizontal plane, a conveyance load attributable to the frictional resistance between medium 101 and media travel surfaces 610A, 610B would be imposed on medium 101. In contrast, in the embodiment, media retreat path 610 is inclined in a way that the height level of media retreat path 610 becomes gradually lower in the retreat direction (A direction) of medium 101. For this reason, the embodiment can reduce the conveyance load in conveying medium 101 along media retreat path 601.

It is desirable that the inclination $\alpha$ of media retreat path 610 be in a range of 5 degrees to 20 degrees, as described above. That is because, if the inclination $\alpha$ of media retreat path 610 is less than 5 degrees, such an inclination reduces the effect of shortening the horizontal length of media conveyance unit 600 for duplex printing, and the effect of decreasing the conveyance load on medium 101. In addition, that is because, if the inclination $\alpha$ of media retreat path 610 exceeds 20 degrees, such an inclination increases the height (vertical dimension) of media conveyance unit 600 for duplex printing. Incidentally, in the embodiment, the most preferable inclination $\alpha$ of media retreat path 610 is 12 degrees which is mentioned above.

Furthermore, media conveyance unit 600 for duplex printing is detachable from main body 11 of image forming apparatus 1, and media retreat path 610 is formed between media conveyance unit 600 for duplex printing and main body 11 of image forming apparatus 1. For these reason, if medium 101 is jammed in media retreat path 610, the embodiment enables media retreat path 610 to be opened by detaching media conveyance unit 600 for duplex printing from main body 11 of image forming apparatus 1, and accordingly makes it possible to remove jammed medium 101.

Second Embodiment

Figure 4:
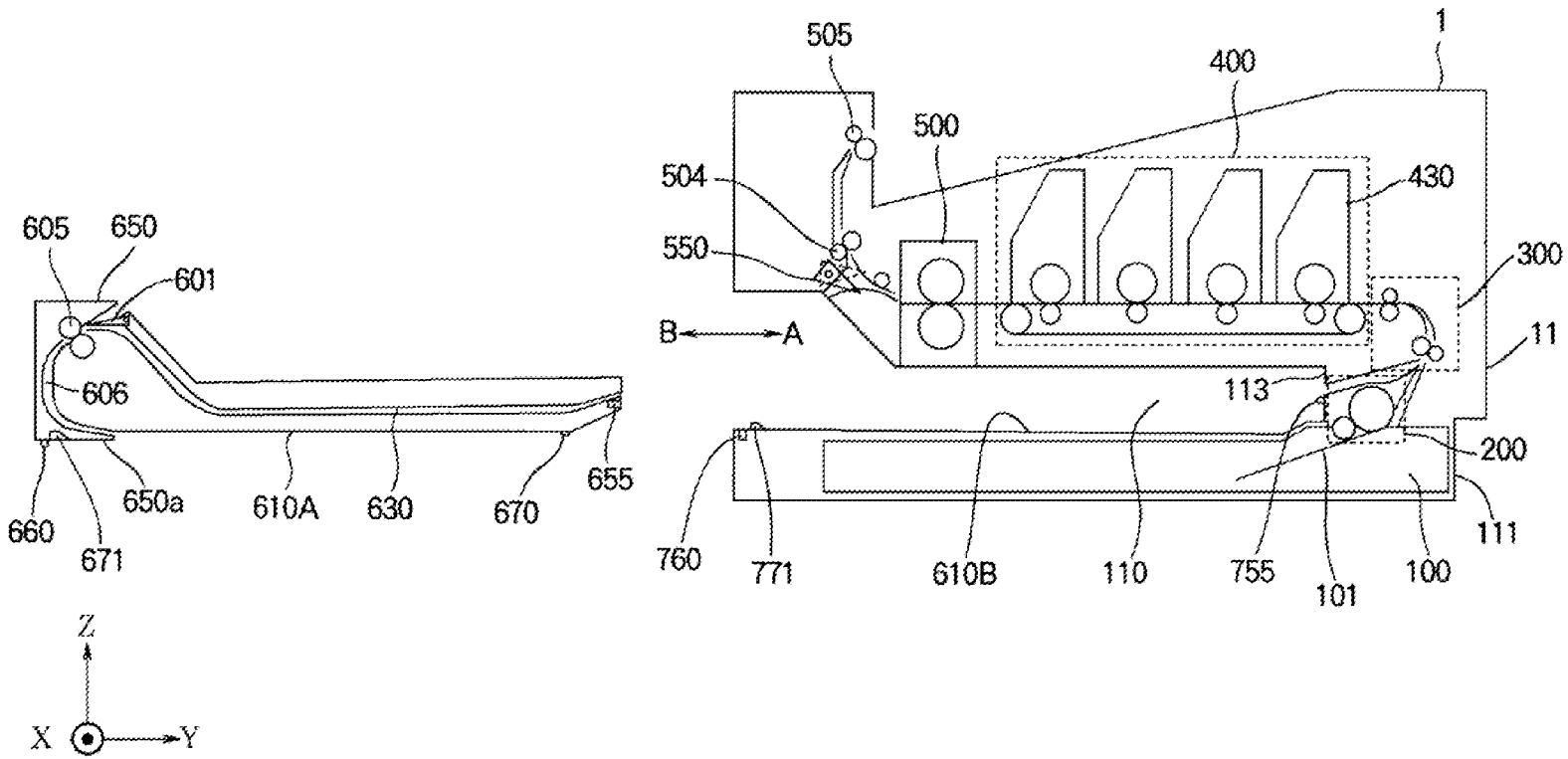
FIG. 4 is a diagram showing an image forming apparatus including a detachable media conveyance unit for duplex printing in a second embodiment of the invention.
Figure 5A:
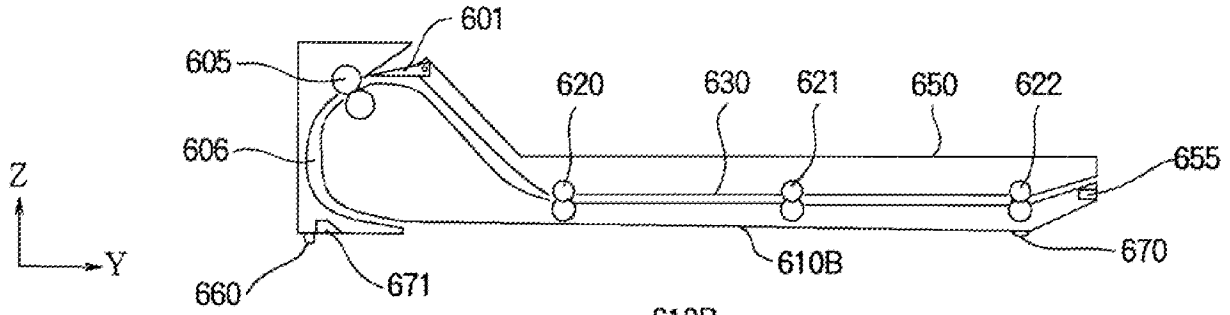
FIGS. 5A and 5B are, respectively, a side view and a bottom view showing the media conveyance unit for duplex printing in the second embodiment of the invention.
Figure 5B:
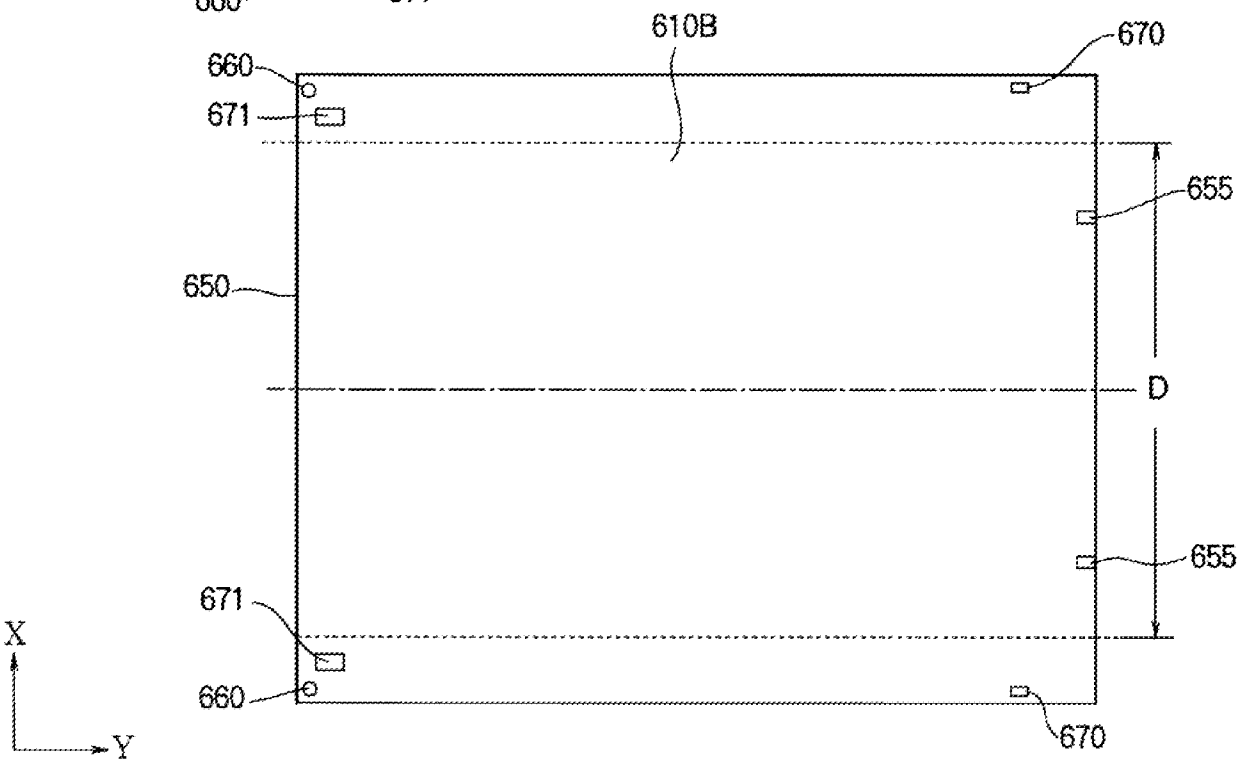

Next, descriptions are provided for a second embodiment of the invention. FIG. 4 is a diagram showing image forming apparatus 1 of the second embodiment of the invention with main body 11 and media conveyance unit 650 for duplex printing separated from each other. FIGS. 5A and 5B are, respectively, a side view and a bottom view showing media conveyance unit 650 for duplex printing of the second embodiment of the invention.

Media retreat path 610 is defined by media travel surface 610A of media conveyance unit 650 for duplex printing and media travel surface 610B of main body 11 of image forming apparatus 1, which is opposed to media travel surface 610A in the same manner as described in the first embodiment. The second embodiment relates to a configuration in which media conveyance unit 650 for duplex printing is attachable to and detachable from main body 11 of image forming apparatus 1.

As shown in FIG. 4, in main body 11 of image forming apparatus 1, hollow portion 110 configured to serve as a space for containing media conveyance unit 650 for duplex printing is formed above main body lower portion 111. Media conveyance unit 650 for duplex printing is installed in hollow portion 110 by being slidingly-inserted in an almost horizontal direction from the left in FIG. 4 (i.e., from a side opposite from the side in which media feed mechanism 200 and media conveyance mechanism 300 are placed). In this respect, the direction in which media conveyance unit 650 for duplex printing is installed (the rightward direction in FIG. 4) is defined as an A direction, and the direction in which media conveyance unit 650 for duplex printing is removed (the leftward direction in FIG. 4) is defined as a B direction.

Paired positioning holes 655 are formed in the front end surface of media conveyance unit 650 for duplex printing in the A direction. In addition, in the vicinity of the rear end portion of undersurface 650*a* of media conveyance unit 650 for duplex printing, paired fit holes 671 are formed in two side portions outside travel range D (see FIG. 5) of medium 101 in the widthwise direction. Furthermore, in the undersurface of media conveyance unit 650 for duplex printing, paired positioning posts (first positioning portions) 660, which are protrusions, are projectingly formed in the vicinity of fit holes 671, respectively.

Moreover, in the front end of media travel surface 610A of media conveyance unit 650 for duplex printing in the A direction, paired first guide ribs (first guide members) 670 are formed in the two side portions of media travel surface 610A which are outside travel range D of medium 101 in the widthwise direction. First guide ribs 670 are, for example, protrusions rounded as a whole.

On the other hand, main body 11 of image forming apparatus 1 has paired positioning posts 755, which are protrusions configured to engage with paired positioning holes 655 of media conveyance unit 650 for duplex printing, in inner wall 113 which is situated in the front end (deep) of hollow portion 110 in the A direction. Positioning posts 755 are protrusions which project from inner wall 113 in the B direction. In addition, paired positioning holes (second positioning portions) 760 configured to engage with paired positioning posts 660 of media conveyance unit 650 for duplex printing, which are described above, are formed in media travel surface 610B which constitutes the bottom of hollow portion 110.

In media travel surface 610B of main body 11 of image forming apparatus 1, paired second guide ribs (second guide members) 771 configured to be fitted, respectively, into paired fit holes 671 of media conveyance unit 650 for duplex printing, which is described above, are formed in the (two side) portions of media travel surface 610B which are outside travel range D of media 101 in the widthwise direction. Second guide ribs 771 are, for example, protrusions shaped almost like a trapezoid with inclined surfaces in the A direction and the B direction.

Figure 6:
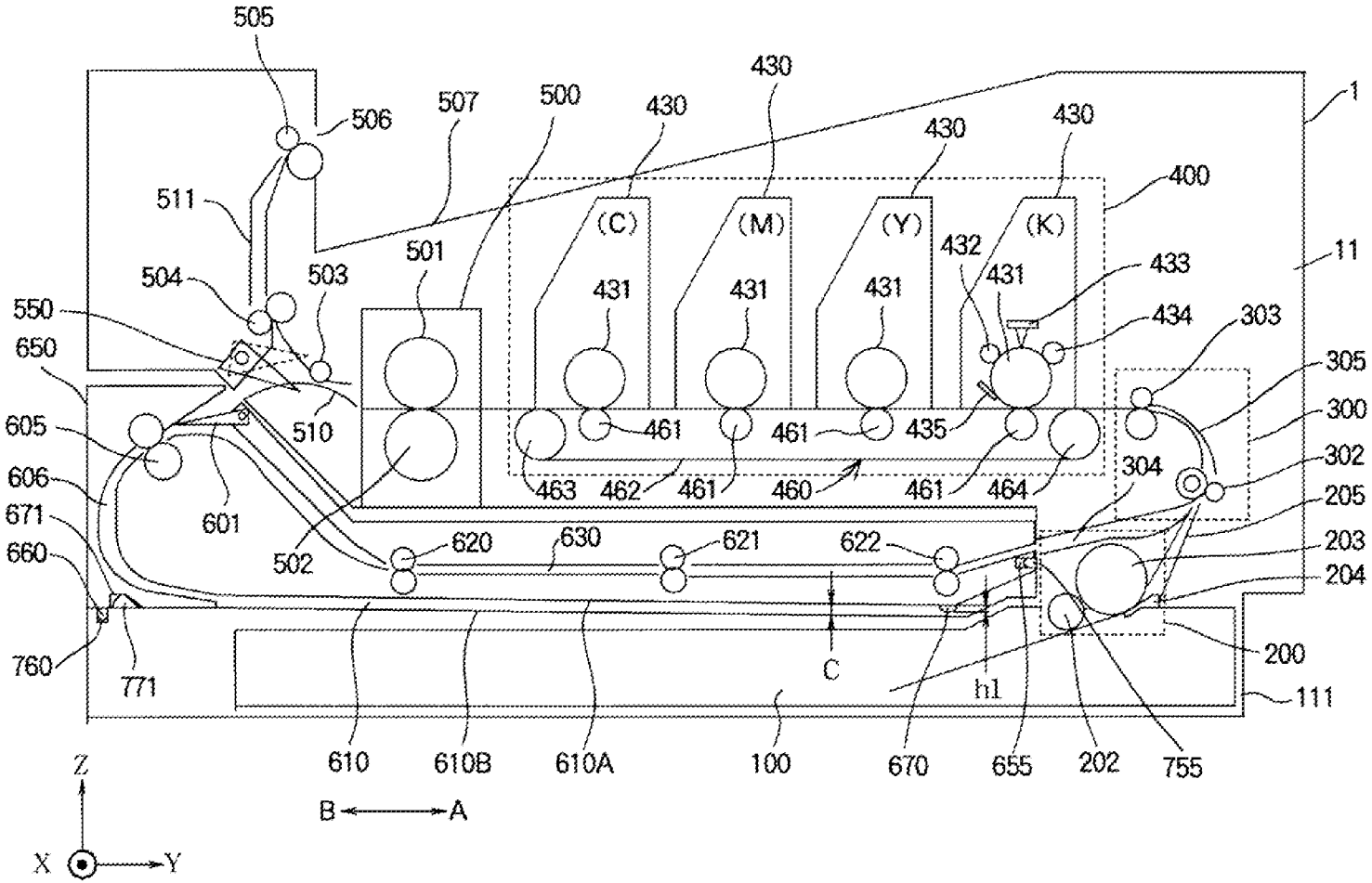
FIG. 6 is a diagram showing a state in which the media conveyance unit for duplex printing in the second embodiment of the invention is attached to a main body of the image forming apparatus.

FIG. 6 is a diagram showing a state in which media conveyance unit 650 for duplex printing is attached to main body 11 of image forming apparatus 1. As shown in FIG. 6, in a state where media conveyance unit 650 for duplex printing is attached to main body 11 of image forming apparatus 1, positioning posts 755 of main body 11 engage with positioning holes 655 in the front end of media conveyance unit 650 for duplex printing, and positioning posts 660 of media conveyance unit 650 for duplex printing engage with positioning holes 760 of main body 11. Thereby, media conveyance unit 650 for duplex printing is positioned and fixed to main body 11 of image forming apparatus 1. In addition, media travel surfaces 610A, 610B are opposed in parallel to each other with predetermined space C (for example, 3 mm) in between.

In this respect, height h1 of first guide ribs 670 is 2 mm, for example. Height h1 of first guide ribs 670 is less than space C (for example, 3 mm) between media travel surface 610A and media travel surface 610B. In addition, height h2 (see FIG. 8) of second guide ribs 771 is 6 mm, for example. Height h3 (see FIG. 8) of positioning posts 660 is 5 mm, for example. In other words, height h2 of second guide ribs 771 is greater than height h3 of positioning posts 660. Furthermore, depth d (see FIG. 8) of fit holes 671 is 7 mm, for example. Depth d of fit holes 671 is greater than height h2 of second guide ribs 771.

For these reasons, in a state where media conveyance unit 650 for duplex printing is attached to main body 11 of image forming apparatus 1, second guide ribs 711 of main body 11 are fitted to fit holes 671 of media conveyance unit 650 for duplex printing. In contrast, first guide ribs 670 of media conveyance unit 650 for duplex printing is away from media travel surface 610B of main body 11, because height h1 of first guide ribs 670 is less than space C between media travel surfaces 610A, 610B.

Figure 7:
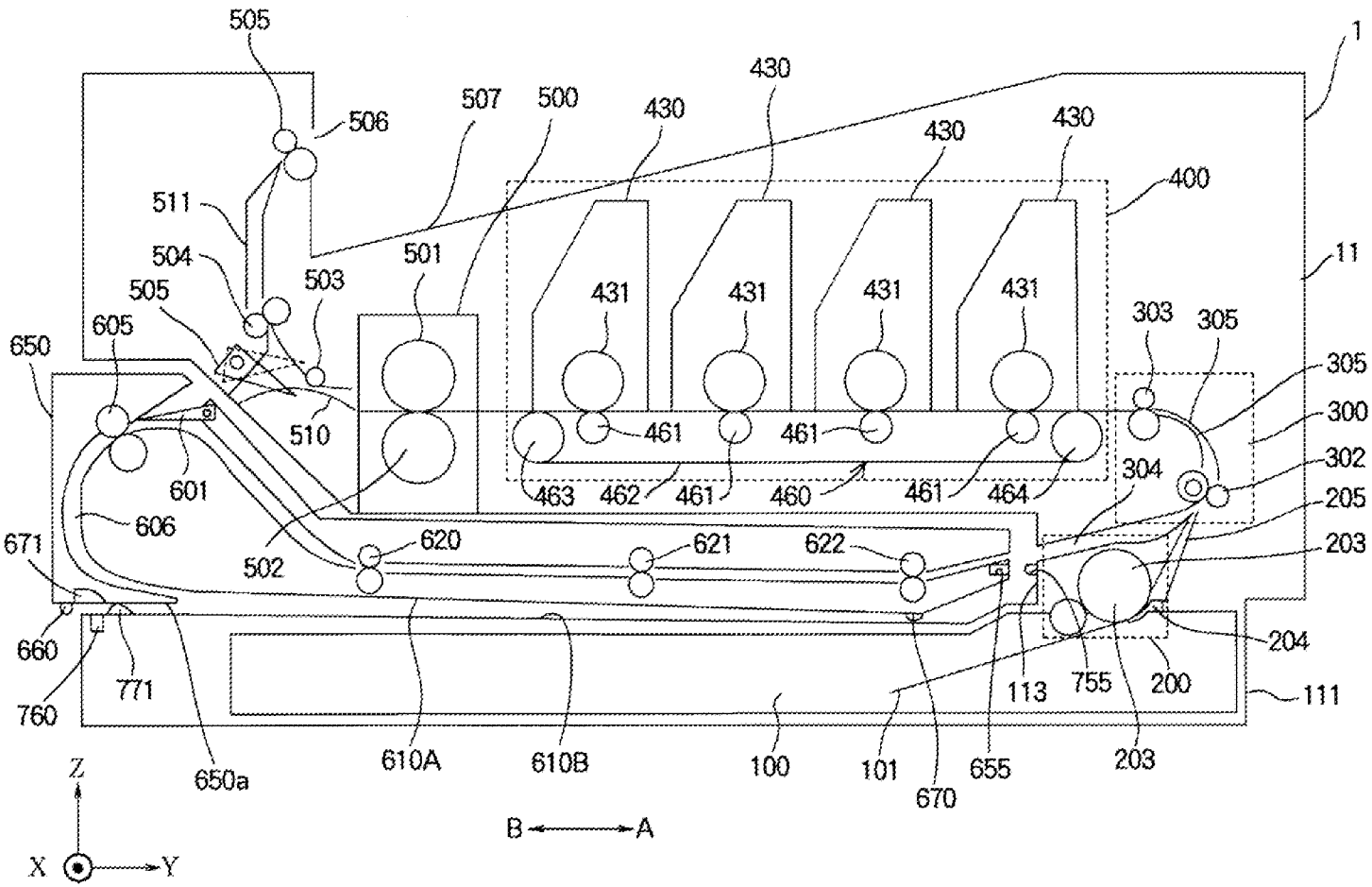
FIG. 7 is a diagram for explaining the operation in which the media conveyance unit for duplex printing in the second embodiment of the invention is attached to the main body of the image forming apparatus.
Figure 8:
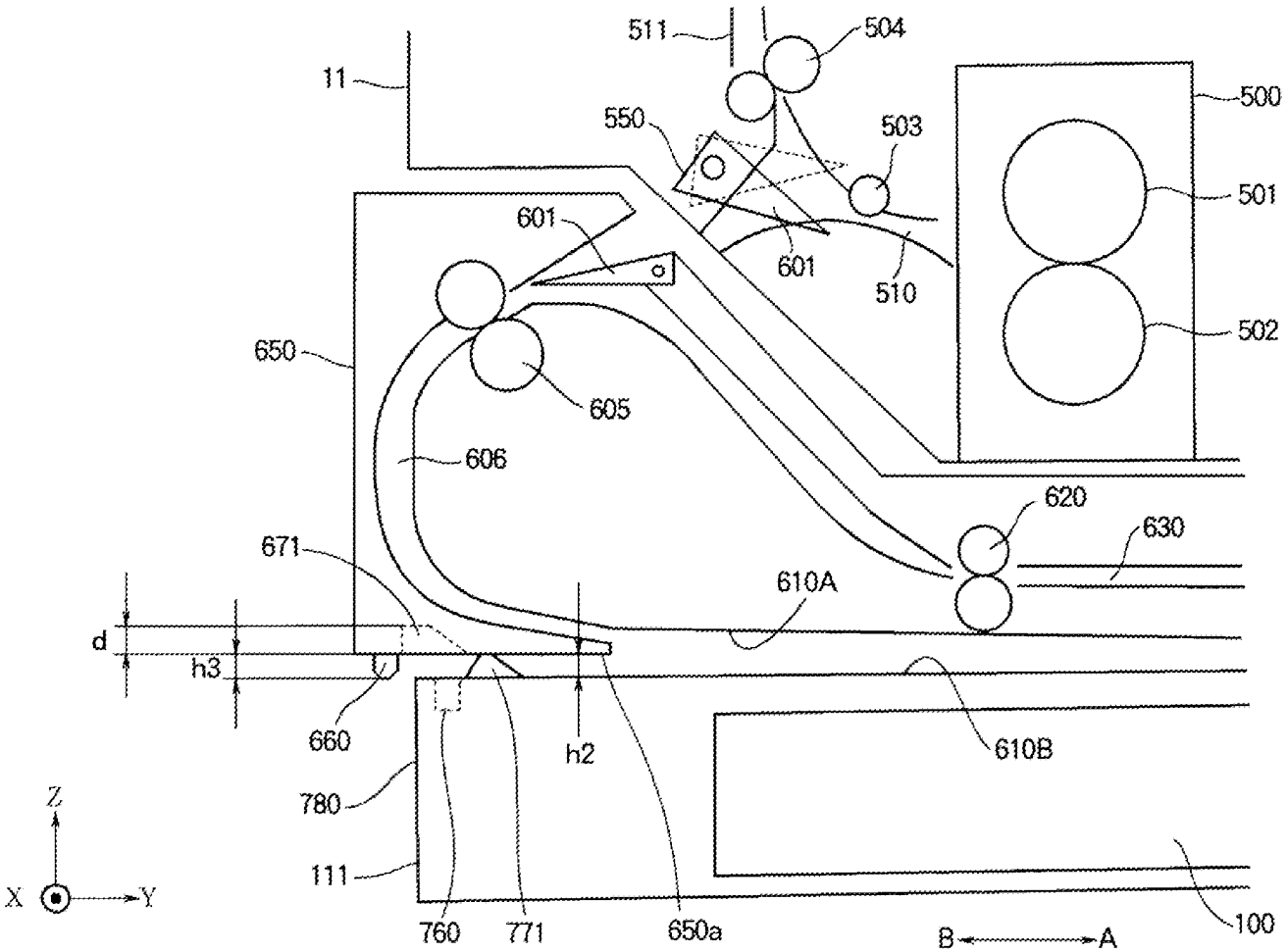
FIG. 8 is a diagram showing a part of FIG. 7 in a magnifying manner.

FIG. 7 is a diagram for explaining the operation in which media conveyance unit 650 for duplex printing is attached to main body 11 of image forming apparatus 1. FIG. 8 is a diagram showing a part of FIG. 7 in a magnifying manner. As shown in FIGS. 7 and 8, when media conveyance unit 650 for duplex printing is attached to main body 11 of image forming apparatus 1, media conveyance unit 650 for duplex printing is inserted into hollow portion 110 formed in main body 11 of image forming apparatus 1 by being slid in the A direction.

At this time, media conveyance unit 650 for duplex printing moves in the A direction while making first guide ribs 670 thereof come into contact with the two side portions of media travel surface 610B of main body 11, which are outside media travel range D in the widthwise direction. In addition, second guide ribs 771 of main body 11 come in contact with the two side portions of media travel surface 610A of media conveyance unit 650 for duplex printing, which are outside media travel range D in the widthwise direction, and thereafter come into contact with undersurface 650*a*.

In this respect, because height h2 of second guide ribs 771 is greater than height h3 of positioning posts 660 of media conveyance unit 650 for duplex printing, positioning posts 660 is not in contact with main body 11 of image forming apparatus 1 in a state where media conveyance unit 650 for duplex printing is inserted therein.

Once media conveyance unit 650 for duplex printing is further inserted into hollow portion 110 of main body 11, positioning posts 755 projectingly provided to inner wall 113 of main body 11 come into engagement with positioning holes 655 in the front end of media conveyance unit 650 for duplex printing in the A direction. Positioning posts 755 are arranged in positions where positioning posts 755 slightly uplift a front end-side portion of media conveyance unit 650 for duplex printing when positioning posts 755 are in engagement with positioning holes 655. In addition, each positioning post 755 has an inclined surface in its projecting tip. Accordingly, the engagement between positioning posts 755 and positioning holes 655 makes first guide ribs 670 come off media travel surface 610B in an upwards direction.

Furthermore, second guide ribs 771 of main body 11 are fitted into fit holes 671 of media conveyance unit 650 for duplex printing. In response to this, positioning posts 660 of media conveyance unit 650 for duplex printing come into engagement with positioning holes 760 of main body 11. Thereby, media conveyance unit 650 for duplex printing is positioned to main body 11 of image forming apparatus 1, and media travel surface 610A and media travel surface 610B become opposed to each other (in other words, media retreat path 610 is formed).

On the other hand, in the course of detaching media conveyance unit 650 for duplex printing from main body 11 of image forming apparatus 1, media conveyance unit 650 for duplex printing is uplifted. Once doing so, positioning posts 660 and positioning holes 670 are disengaged from each other, and positioning holes 655 and positioning posts 755 are disengaged from each other. While in this state, media conveyance unit 650 for duplex printing is drawn from hollow portion 110 in the B direction. Thereby, media conveyance unit 650 for duplex printing can be detached from main body 11 of image forming apparatus 1.

It should be noted that as shown in FIG. 8, in the course of drawing media conveyance unit 650 for duplex printing from hollow portion 110, second guide ribs 771, which come off fit holes 671, come into contact with undersurface 650*a* of media conveyance unit 650 for duplex printing. Because height h2 of second guide ribs 771 is greater than height h3 of positioning posts 660, positioning posts 660 do not come into contact with main body 11 of image forming apparatus 1. Because, as described above, positioning posts 660 do not come into contact with main body 11 of image forming apparatus 1 in the course of both the attachment and detachment of media conveyance unit 650 for duplex printing, it is possible to prevent main body 11 of image forming apparatus 1 from being damaged due to contact with positioning posts 660.

Figure 9A:
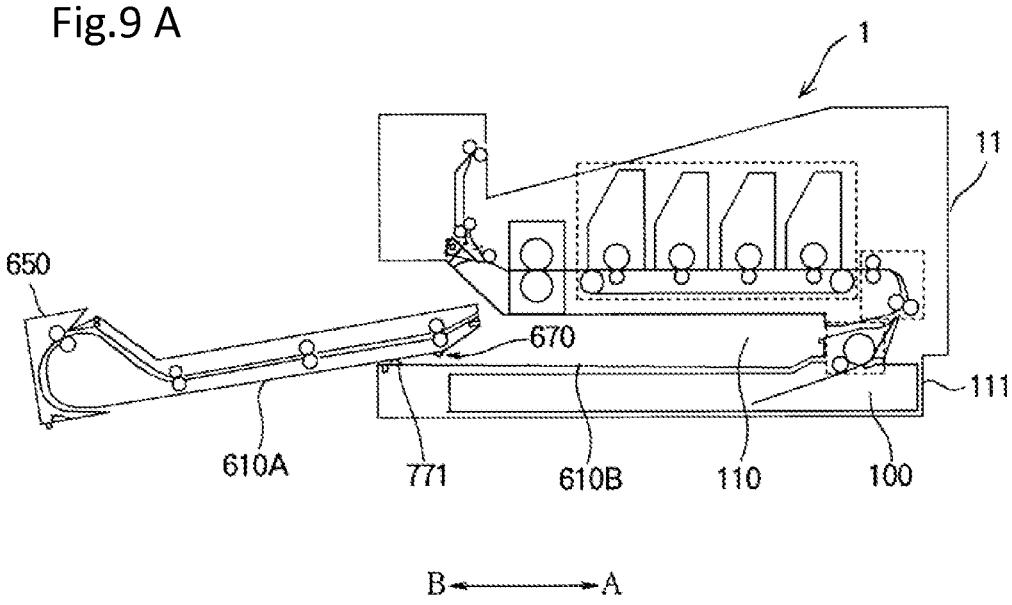
FIGS. 9A and 9B are diagrams schematically showing the operation in which the media conveyance unit for duplex printing in the second embodiment of the invention is attached to and detached from the main body of the image forming apparatus.
Figure 9B:
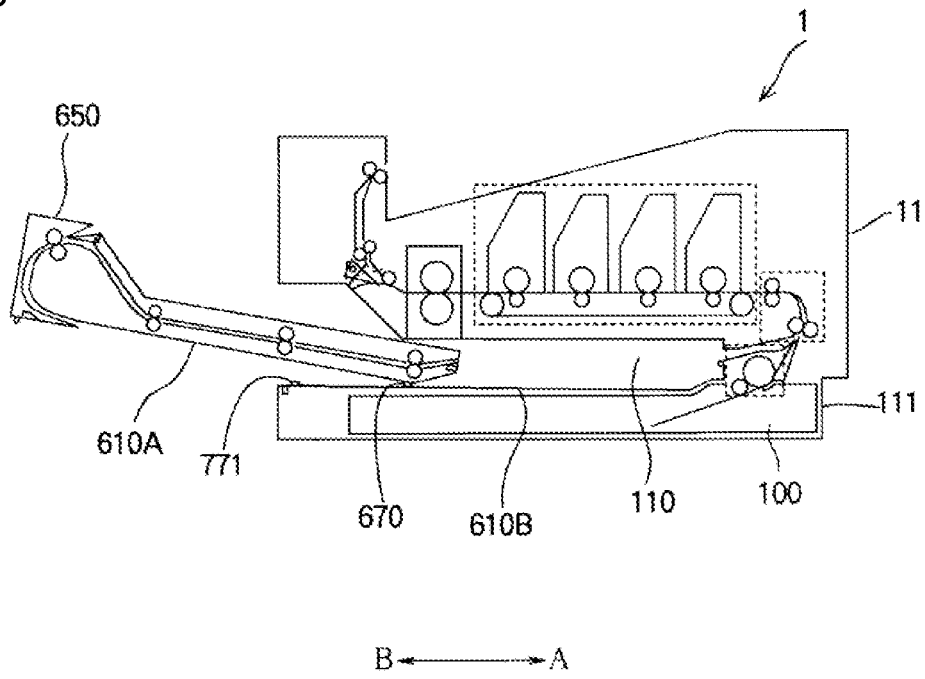

FIGS. 9A and 9B are diagrams schematically showing operation in which media conveyance unit 650 for duplex printing is attached to and detached from main body 11 of image forming apparatus 1. In a case where as shown in FIG. 9A, media conveyance unit 650 for duplex printing tilts in the course of attaching or detaching media conveyance unit 650 for duplex printing to or from main body 11 of image forming apparatus 1, the portions of media travel surface 610A (see FIG. 5), which are outside media travel range D in the widthwise direction, move while sliding on second guide ribs 771 of main body 11. Otherwise, in a case where media conveyance unit 650 for duplex printing tilts as shown in FIG. 9B, first guide ribs 670 of media conveyance unit 650 for duplex printing move while sliding along the portions of media travel surface 610B of main body 11, which are outside media travel range D in the widthwise direction. In both cases, any other member does not come into contact with media travel range D of media travel surface 610A or with media travel range D of media travel surface 610B. For this reason, it is possible to prevent media travel range D of each of media travel surfaces 610A, 610B from being damaged.

Figure 10A:
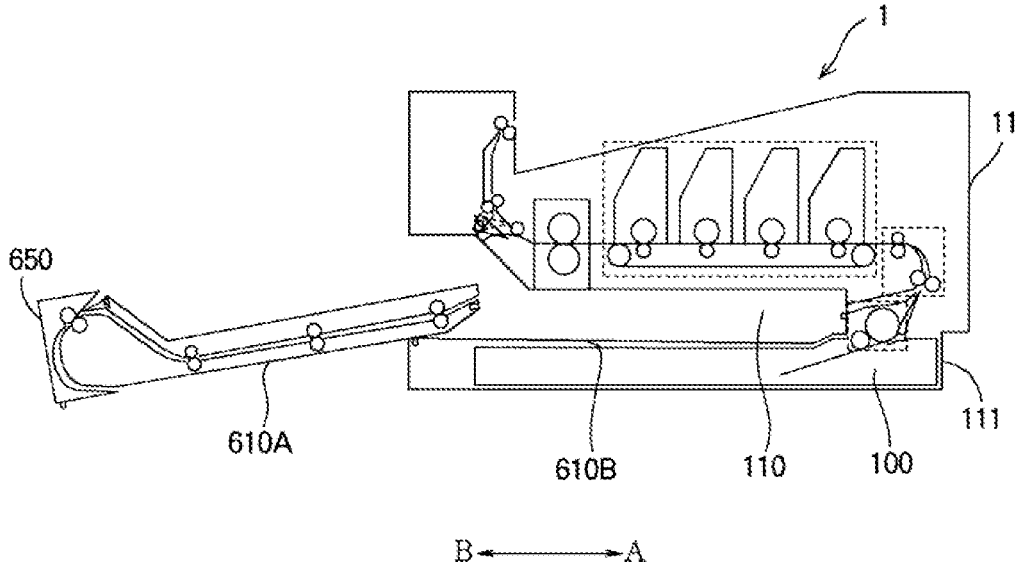
FIGS. 10A and 10B are diagrams for explaining the operation in which the media conveyance unit for duplex printing is attached to and detached from the main body of the image forming apparatus in a case where no first or second guide ribs are provided thereto in the second embodiment of the invention.
Figure 10B:
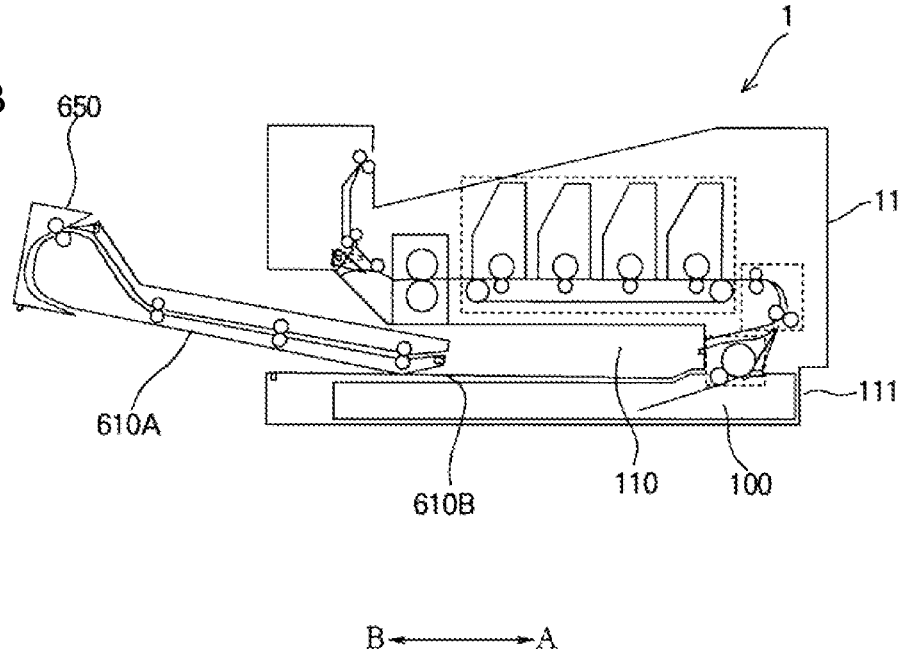

FIGS. 10A and 10B are diagrams showing an attachment/detachment operation which is performed in a case where neither second guide ribs 771 nor first guide ribs 670 are included. FIGS. 10A and 10B give a comparison to the attachment/detachment operation shown in FIGS. 9A and 9B with such an attachment/detachment operation in the absence of guide ribs on the media conveyance unit. In this case where media conveyance unit 650 for duplex printing tilts as shown in FIG. 10A, media travel surface 610A (including media travel range D) comes into contact with, for example, a corner in the entrance of hollow portion 110 in main body 11 of image forming apparatus 1. In addition, in a case where media conveyance unit 650 for duplex printing tilts as shown in FIG. 10B, a lower portion of media conveyance unit 650 for duplex printing comes into contact with media travel surface 610B (including media travel range D). For these reasons, a part of media travel range D of either of media travel surfaces 610A and 610B is likely to be damaged.

In contrast, the embodiment makes it possible to prevent a part of media travel range D of each of media travel surfaces 610A and 610B from being damaged, because the portions of media travel surface 610A, which are outside media travel range D (FIG. 5B) in media retreat path 610, move while sliding on second guide ribs 771 (see FIG. 9A), or because the portions of media travel surface 610B, which are outside media travel range D, in media retreat path 610 (FIG. 1) move while sliding on first guide ribs 670 (see FIG. 9B).

As described above, the second embodiment of the invention makes it possible to make media conveyance unit 650 for duplex printing smaller because media retreat path 610 is formed between media conveyance unit 650 for duplex printing and main body 11 of image forming apparatus 1. Furthermore, the second embodiment of the invention makes it possible to reduce the horizontal length of media conveyance unit 650 for duplex printing, and to decrease the conveyance load attributable to the frictional resistance of medium 101 which moves in media retreat path 610, because media retreat path 610 is inclined to the horizontal plane.

In addition, during the attachment and detachment of media conveyance unit 650 for duplex printing, the second embodiment of the invention makes it possible to prevent media travel surfaces 610A, 610B (media travel ranges D) from being damaged. That is because during the attachment and detachment of media conveyance unit 650 for duplex printing, second guide ribs 771 of main body 11 of image forming apparatus 1 come into contact with the portions of media travel surface 610A which are outside media travel range D in the widthwise direction, and first guide ribs 670 of media conveyance unit 650 for duplex printing come into contact with the portions of media travel surface 610B which are outside media travel range D in the widthwise direction.

Furthermore, in a state where media conveyance unit 650 for duplex printing is attached to main body 11 of image forming apparatus 1, first guide ribs 670 are not in contact with media travel surface 610B because: first guide ribs 670 of media conveyance unit 650 for duplex printing are the protrusions; and height h1 (the amount of projection) of first guide ribs 670 is less than space C between media travel surfaces 610A, 610B. Because of this, the positioning of the front end portion of media conveyance unit 650 for duplex printing in the A direction is achieved by use of positioning posts 755 and positioning holes 655. Accordingly, first guide ribs 670 are prevented from interfering with the positioning.

The embodiment is described in which positioning posts 755 of main body 11 engage with positioning holes 655 of media conveyance unit 650 for duplex printing, while positioning posts 660 of media conveyance unit 650 for duplex printing engage with positioning holes 760 of main body 11. However, it goes without saying that the relationship between the positioning posts and positioning holes may be reversed.

The first and second embodiments are described in which media conveyance unit 650 for duplex printing is attachable to and detachable from main body 11 of image forming apparatus 1. In the first embodiment, however, media conveyance unit 650 for duplex printing does not necessarily have to be attachable to, or detachable from, main body 11 of image forming apparatus 1.

As the first and second embodiments, the electrophotographic printer is described in which four toner image forming sections 430 are arranged in a row. However, the invention is not necessarily limited to this configuration. The invention may be carried out as a single-color image forming apparatus, for example.

Moreover, in the first and second embodiments, the electrophotographic printer is described. However, the invention is applicable as well to inkjet printers and multi-function printers. Furthermore, the invention is applicable to image forming apparatuses, such as facsimile machines and copying machines, beyond printers.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image forming apparatus comprising:

a main body including an image forming unit configured to form an image on a medium, and a media conveyance mechanism configured to convey the medium to the image forming unit;

a media conveyance unit attached to the main body and configured to convey the medium to the media conveyance mechanism; and a media retreat path defined by paired opposed surfaces of the media conveyance unit and the main body and configured to receive at least a part of the medium when being retreated, the media retreat path inclined in a way that a height level of the media retreat path gradually becomes lower from its entrance side to its back-end side, wherein the media conveyance unit includes a return conveyance path provided therein, wherein the media retreat path is provided outside of the return conveyance path, and wherein the media retreat path is defined by way of a surface of the media conveyance unit and a surface of the main body that is opposed to the surface of the media conveyance unit, wherein the media conveyance unit is detachable from the main body, and wherein the media retreat path corresponds to a path located between the upper surface of the main body and the lower surface of the media conveyance unit upon attachment of the media conveyance unit with the main body.

2. The image forming apparatus according to claim 1, wherein the media conveyance unit is a media conveyance unit for duplex printing configured to return the medium, passed through the image forming unit, to the media conveyance mechanism with a back surface of the medium faced up.

3. The image forming apparatus according to claim 2, wherein the media conveyance unit for duplex printing comprises:

a conveyance mechanism configured to selectively convey the medium in a direction in which the medium is retreated into the media retreat path, and in a direction in which the medium is ejected from the media retreat path;

the return conveyance path is configured to convey the medium, ejected from the media retreat path by the conveyance mechanism, to the media conveyance mechanism; and an intermediate conveyance path connecting the media retreat path and the return conveyance path together.

4. The image forming apparatus according to claim 1, wherein an angle of inclination of the media retreat path to a horizontal plane is in a range of 5 degrees to 20 degrees.

5. The image forming apparatus according to claim 4, wherein the main body includes a second guide member configured to come into contact with the opposed surface of the media conveyance unit which defines the media retreat path, during attachment and detachment of the media conveyance unit to and from the main body.

6. The image forming apparatus according to claim 5, wherein the second guide member is provided in a portion in the opposed surface of the main body which defines the media retreat path, the portion being outside a media travel range in a widthwise direction.

7. The image forming apparatus according to claim 5, wherein in a state where the media conveyance unit is attached to the main body, the second guide member of the main body is fitted in a fit hole formed in the media conveyance unit.

8. The image forming apparatus according to claim 5, wherein the media conveyance unit and the main body respectively include a first positioning portion and a second positioning portion configured to engage with each other in a direction of a space of the media retreat path, one of the first and second positioning portions is a protrusion projecting from one to the other of the opposed surfaces which define the media retreat path, and an amount of projection of the protrusion is less than a height of the second guide member.

9. The image forming apparatus according to claim 1, wherein the media conveyance unit includes a first guide member configured to come into contact with the opposed surface of the main body which defines the media retreat path, during attachment and detachment of the media conveyance unit to and from the main body.

10. The image forming apparatus according to claim 9, wherein the first guide member is provided in a portion of the opposed surface of the media conveyance unit which defines the media retreat path, the portion being outside a media travel range in a widthwise direction.

11. The image forming apparatus according to claim 9, wherein the first guide member comprises a protrusion formed on the opposed surface of the media conveyance unit which defines the media retreat path, and an amount of projection of the protrusion is less than a space between the paired opposed surfaces which define the media retreat path.

12. The image forming apparatus according to claim 1, wherein the media retreat path gradually becomes higher from a predetermined distance from its back-end side to its back-end side.

13. The image forming apparatus according to claim 1, wherein the media retreat path is a path that is positioned substantially in parallel to the return conveyance path.

14. An image forming apparatus comprising:

a main body including an image forming unit configured to form an image on a medium, and a media conveyance mechanism configured to convey the medium to the image forming unit;

a media conveyance unit attached to the main body and configured to convey the medium to the media conveyance mechanism; and a media retreat path defined by paired opposed surfaces of the media conveyance unit and the main body, and configured to receive at least a part of the medium being retreated, wherein the media conveyance unit includes a return conveyance path provided therein, wherein the media retreat path is provided outside of the return conveyance path, and wherein the media retreat path is defined by way of a surface of the media conveyance unit and a surface of the main body that is opposed to the surface of the media conveyance unit, wherein the media conveyance unit is detachable from the main body, and wherein the media retreat path corresponds to a path located between the upper surface of the main body and the lower surface of the media conveyance unit upon attachment of the media conveyance unit with the main body.

15. The image forming apparatus according to claim 14, wherein the media conveyance unit is a media conveyance unit for duplex printing which includes the return conveyance path and is configured to connect a downstream portion of the image forming unit and an upstream portion of the media conveyance mechanism, and to return the medium, passed through the image forming unit, to the media conveyance mechanism with a back surface of the medium faced up.

16. The image forming apparatus according to claim 15, wherein the main body includes a second guide member configured to come into contact with the opposed surface of the media conveyance unit which defines the media retreat path, during attachment and detachment of the media conveyance unit to and from the main body.

17. The image forming apparatus according to claim 16, wherein the second guide member is provided in a portion of the opposed surface of the media conveyance unit which defines the media retreat path, the portion being outside a media travel range in a widthwise direction.

18. The image forming apparatus according to claim 16, wherein in a state where the media conveyance unit is attached to the main body, the second guide member of the main body is fitted in a fit hole formed in the media conveyance unit.

19. The image forming apparatus according to claim 16, wherein the media conveyance unit and the main body respectively include a first positioning portion and a second positioning portion which engage with each other in a direction of a space of the media retreat path, the first or second positioning portion is a protrusion projecting from one to the other of the opposed surfaces which define the media retreat path, and an amount of projection of the protrusion is less than a height of the second guide member.

20. The image forming apparatus according to claim 14, wherein the media conveyance unit includes a first guide member configured to come into contact with the opposed surface of the main body which defines the media retreat path during attachment and detachment of the media conveyance unit to and from the main body.

21. The image forming apparatus according to claim 20, wherein the first guide member is provided in a portion of the opposed surface of the main body which defines the media retreat path, the portion being outside a media travel range in a widthwise direction.

22. The image forming apparatus according to claim 20, wherein the first guide member comprises a protrusion formed on the opposed surface of the main body which defines the media retreat path, and an amount of projection of the protrusion is less than a space between the paired opposed surfaces which define the media retreat path.

23. The image forming apparatus according to claim 14, wherein the media retreat path is inclined in a way that a height level of the media retreat path gradually becomes lower from its entrance side to a predetermined distance from its back-end side, and wherein the media retreat path gradually becomes higher from the predetermined distance from its back-end side to its back-end side.

24. The image forming apparatus according to claim 14, wherein the media retreat path is path is positioned substantially in parallel to the return conveyance path.

* * * * *

UNITED STATES PATENT AND TRADEMARK OFFICE

CERTIFICATE OF CORRECTION

PATENT NO. : 8,613,443 B2
APPLICATION NO. : 13/409430
DATED : December 24, 2013
INVENTOR(S) : Keigo Matsumoto It is certified that error appears in the above-identified patent and that said Letters Patent is hereby corrected as shown below:

Title Page, Item (30) Foreign Application Priority Data

Incorrect: (JP) .....2010-044712

Correct: (JP) .....2011-044712

Signed and Sealed this
Twenty-fifth Day of February, 2014

Michelle K. Lee

Michelle K. Lee
*Deputy Director of the United States Patent and Trademark Office*